US007059316B1

(12) United States Patent
Tseng

(10) Patent No.: US 7,059,316 B1
(45) Date of Patent: Jun. 13, 2006

(54) PAINTBALL SHOOTING STRUCTURE FOR A PAINTBALL GUN

(76) Inventor: Jui-Fu Tseng, No. 5, Alley 2, Lane 333, Yonghe Rd. Taipei Country 235, Jhonghe City (TW)

( * ) Notice: Subject to any disclaimer, the term of this patent is extended or adjusted under 35 U.S.C. 154(b) by 0 days.

(21) Appl. No.: 10/906,829

(22) Filed: Mar. 8, 2005

(51) Int. Cl.
*F41B 11/00* (2006.01)

(52) U.S. Cl. ..... 124/74; 102/440; 102/438; 222/3

(58) Field of Classification Search ..... 124/71, 124/74–77, 48, 57, 59, 60; 102/502, 513, 102/440, 444, 438
See application file for complete search history.

(56) References Cited

U.S. PATENT DOCUMENTS

| | | | | | |
|---|---|---|---|---|---|
| 2,327,653 | A * | 8/1943 | Lisle | 124/57 |
| 4,531,458 | A * | 7/1985 | Saxby | 102/440 |
| 4,834,058 | A * | 5/1989 | Gegere | 124/29 |
| 5,187,323 | A * | 2/1993 | Saxby | 102/440 |
| 5,700,972 | A * | 12/1997 | Saxby | 102/440 |
| 5,962,805 | A * | 10/1999 | Saxby | 102/440 |
| 6,675,791 | B1 * | 1/2004 | Alexander et al. | 124/71 |
| 6,868,846 | B1 * | 3/2005 | Jzn | 124/74 |
| 6,901,923 | B1 * | 6/2005 | Jones | 124/77 |
| 2004/0226549 | A1 * | 11/2004 | Jzn | 124/74 |
| 2005/0193999 | A1 * | 9/2005 | Lai et al. | 124/71 |
| 2006/0011183 | A1 * | 1/2006 | Dziob | 124/71 |
| 2006/0037597 | A1 * | 2/2006 | Wood | 124/73 |

* cited by examiner

*Primary Examiner*—Michael J. Carone
*Assistant Examiner*—Stewart Knox
(74) *Attorney, Agent, or Firm*—Alan D. Kamrath; Nikolai & Mersereau, P.A.

(57) ABSTRACT

A paintball shooting structure includes a cartridge in combination with a percussion device to receive multiple paintballs therein and is provided for a paintball gun. When an impact section of a firing pin of the percussion device is struck, the striking force pushes the firing pin to move forward such that the total length from a plug head formed in a front end of the plug to the impact section is shortened. Meanwhile, compressed gas is released out of the cartridge to push the plug to move rearward along an annular section of an outer sheath. Besides, the compressed gas immediately rushes into each paintball feeder in the cartridge so as to shoot each paintball in a respective one of the paintball feeders out of the cartridge.

7 Claims, 3 Drawing Sheets

PAINTBALL SHOOTING STRUCTURE FOR A PAINTBALL GUN

BACKGROUND OF THE INVENTION

1. Field of the Invention

The present invention relates to a paintball shooting structure for a paintball gun. More specifically, this invention relates primarily to a cartridge receiving several paintballs inside, in combination with a percussion device for use in a paintball gun.

2. Description of Related Art

A conventional paintball gun is designed for shooting a paintball along a barrel thereof by compressed gas. However, this type of paintball gun only shoots one paintball at a time and cannot satisfy the thrill needs of a user in the sport of paintball battles. Hence, it is desirable to improve the shortcomings of the conventional paintball gun so as to further simulate the real situation of a gun battle.

SUMMARY OF THE INVENTION

An objective of the present invention is to provide a paintball shooting structure for a paintball gun to receive multiple paintballs and shoot the multiple paintballs at a single loading, which resembles a real semi-automatic fire arm, so as to satisfy the thrill needs of a user having this type of paintball gun.

Based on the aforementioned objective, the paintball shooting structure of the present invention comprises a cartridge in combination with a percussion device to receive multiple paintballs therein and is provided for a paintball gun.

The cartridge has a pressure chamber for injecting compressed gas, and multiple paintball feeders for receiving a respective one of the paintballs therein and serving as trajectory channels for the paintballs.

The percussion device comprises a plug for controlling the release of the compressed gas in the pressure chamber, a firing pin for actuating the plug, and an outer sheath enveloping the plug and the firing pin inside and guiding the compressed gas released from the pressure chamber to the paintball feeders.

Other and further features, advantages and benefits of the invention will become apparent in the following description taken in conjunction with the following drawings. It is to be understood that the foregoing general description and following detailed description are exemplary and explanatory but are not to be restrictive of the invention. The accompanying drawings are incorporated in and constitute a part of this application and, together with the description, serve to explain the principles of the invention in general terms. Like numerals refer to like parts throughout the disclosure.

BRIEF DESCRIPTION OF THE DRAWINGS

The objects, spirits and advantages of the preferred embodiments of the present invention will be readily understood by the accompanying drawings and detailed descriptions, wherein.

DETAILED DESCRIPTION OF THE PREFFERED EMBODIMENT

Figure 1:
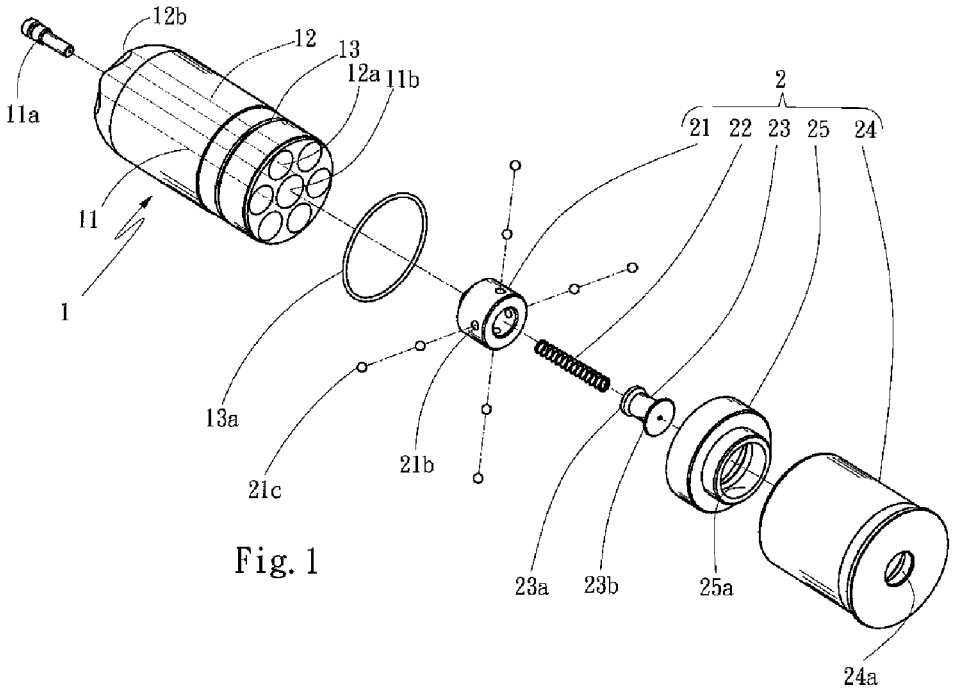
FIG. 1 is an exploded view of the paintball shooting structure constructed in accordance with the present invention.
Figure 2:
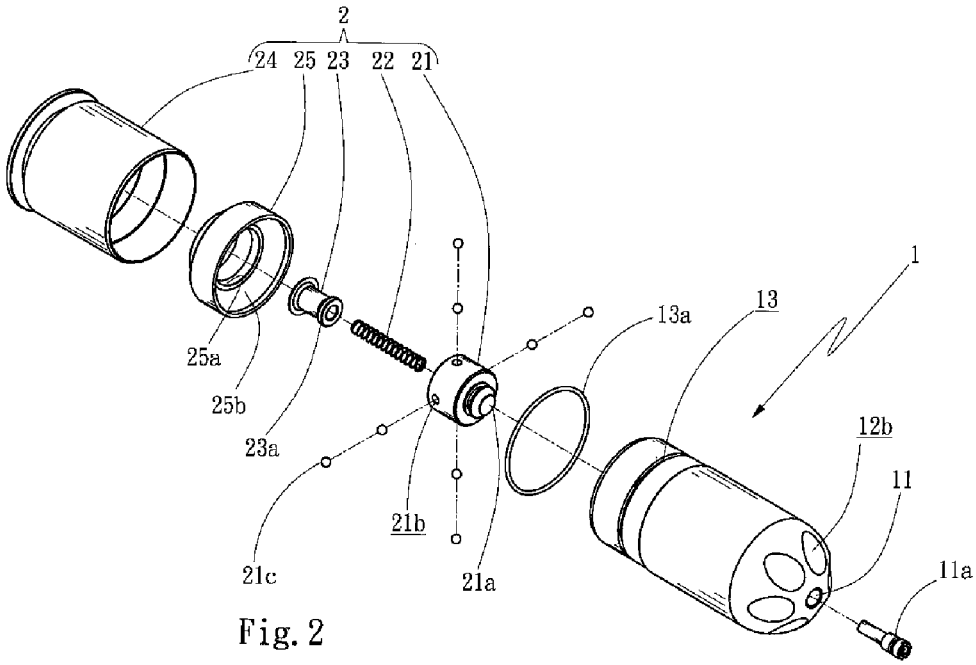
FIG. 2 is an exploded view from another view angle of the paintball shooting structure.

FIG. 1 is an exploded view of the paintball shooting structure constructed in accordance with the present invention; FIG. 2 is an exploded view from another view angle of the paintball shooting structure; and FIG. 3 is a cross sectional view of the paintball shooting structure.

Figure 3:
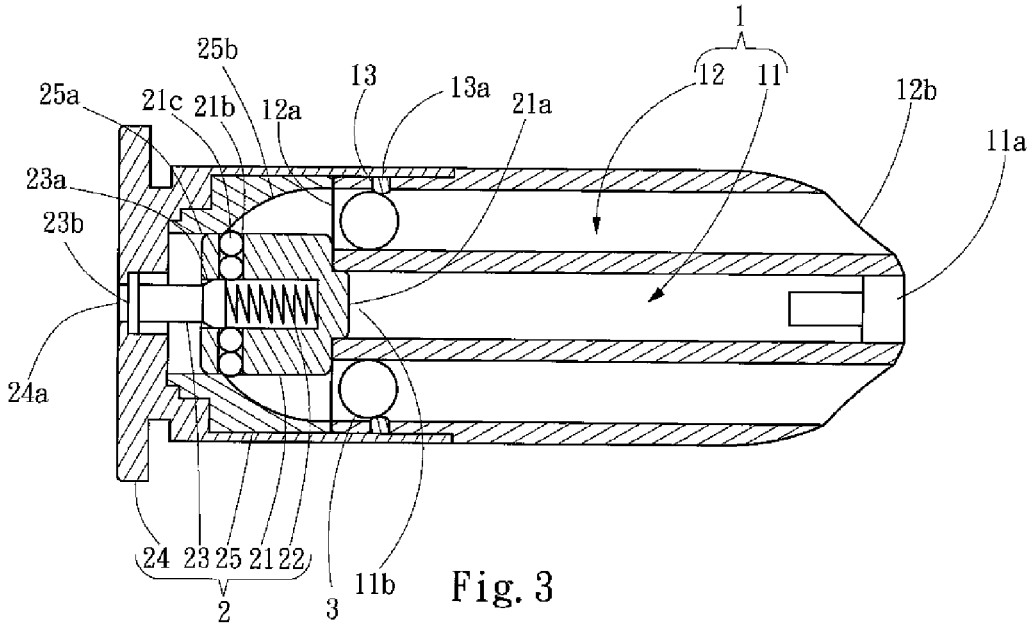
FIG. 3 is a cross sectional view of the paintball shooting structure.

With reference to FIG. 1, FIG. 2 and FIG. 3, the paintball shooting structure comprises a cartridge (1) and a percussion device (2) for a paintball gun (not shown in FIGS. 1, 2 and 3).

The cartridge (1) is a cylindrical body and forms therein a pressure chamber (11) and multiple paintball feeders (12); in preferable way, the multiple paintball feeders (12) surround the pressure chamber (11). The pressure chamber has a gas injection inlet (11*a*) with a non-return structure disposed in a front end of the cartridge (1) for injecting compressed gas into the pressure chamber and a decompression opening (11*b*) defined in a rear end of the cartridge (1) for releasing the compressed gas. Each of the paintball feeders (12) is a chamber with a paintball inlet (12*a*) in the rear end of the cartridge (1) communicating with a paintball outlet (12*b*) in the front end of the cartridge (1) for receiving a paintball (3).

Furthermore, there is an annular recess (13) defined in an outer periphery of the cartridge (1) and having such a depth that is able to communicate with the paintball feeders (12). A resilient rubber collar (13*a*) is received in the annular recess (13). The position of the annular recess (13) in an axial direction from the paintball inlet (12*a*) of the cartridge (1) is to match up the dimension of the paintball (3) to restrict the paintball (3) to be located near the paintball inlet (12*a*).

The percussion device (2) comprises a plug (21), a spring (22), a firing pin (23), and an outer sheath (24). The plug (21) is a cylinder with a closed front end and an open rear end and has a receiving room therein communicating with the open rear end. On the closed front end is formed a plug head (21*a*) which is engaged with the pressure chamber (11) via a decompression opening (11*b*) to close the decompression opening (11*b*). The plug (21) has multiple receiving holes (21*b*) separately arranged around an annular outer side face of the plug and extending though the side wall of the plug. At least one ball (21*c*) (two balls used in this embodiment) is received in a respective one of the receiving holes (21*b*) and the most interior ball (21*c*) partially emerges out of an inner surface of the plug. The spring (22) is received in the receiving room of the plug (21). The firing pin (23) is a cylindrical object that has a flange (23*a*) at a front end of the firing pin (23) and an impact section (23*b*) formed at a rear end of the firing pin (23). The outer sheath (24) is a tubular body with an open front end to engage with the cartridge (1) and has a through hole (24*a*) defined in a closed rear end of the outer sheath (24). The through hole diameter is smaller than that the diameter of the impact section (23*b*) to limit the motion of the impact section (23*b*) to abut a rear inner face of the outer sheath (24).

Besides, the outer sheath (24) is provided with a hollow trough body (25) that has a hollow annular section (25*a*) formed on a rear edge of the trough body for receiving the plug (21) to slide therein, and a bowl-like inner face (25*b*) gradually expanded from an inner edge face of the annular section (25*a*). The largest radial dimension of the bowl-like inner face (25*b*) is larger than the arrangement range of the decompression opening (11*b*) and the paintball inlets (12*a*). When the compressed gas is released from the decompression opening (11*b*) of the pressure chamber (11), this type of bowl-like inner face (11*b*) is able to distribute evenly the compressed gas to each paintball inlet (12*a*). Of course, any type of inner face that can evenly distribute the compressed gas to each paintball inlet (12*a*) is permitted, such as staircase-like inner face, etc.

The most exterior ball (21*c*) received in a respective one of the receiving holes (21*b*) also partially emerges out of an outer surface of the plug such that the most exterior ball (21*c*) can reduce the friction between the plug (21) and the inner face of the annular section (25*a*) when the plug (21) slides in the annular section (25*a*).

When the cartridge (1) and the percussion device (2) are assembled, the percussion device (2) is engaged with the rear portion of the percussion device (2), in which the outer sheath (24) is securely engaged with the outer face of the cartridge (1) to attain a hermetic condition. The flange (23*a*) of the firing pin (23) is limited by the ball (21*c*) partially emerged out of the inner face of the plug and slightly compressed rearwards by the spring (22) received in the plug (21). Thus, the impact section (23*b*) of the firing pin (23) is abutted against the rear end of the outer sheath (24) and aligned with the through hole (24*b*) of the outer sheath (24). The plug head (21*a*) is inserted into the decompression opening (11*b*) in the rear end of the cartridge (1) to attain a hermetic condition. Accordingly, the plug (21) is restricted between the rear end of the cartridge (1) and the annular section (25*a*) of the trough body (25).

Figure 4:
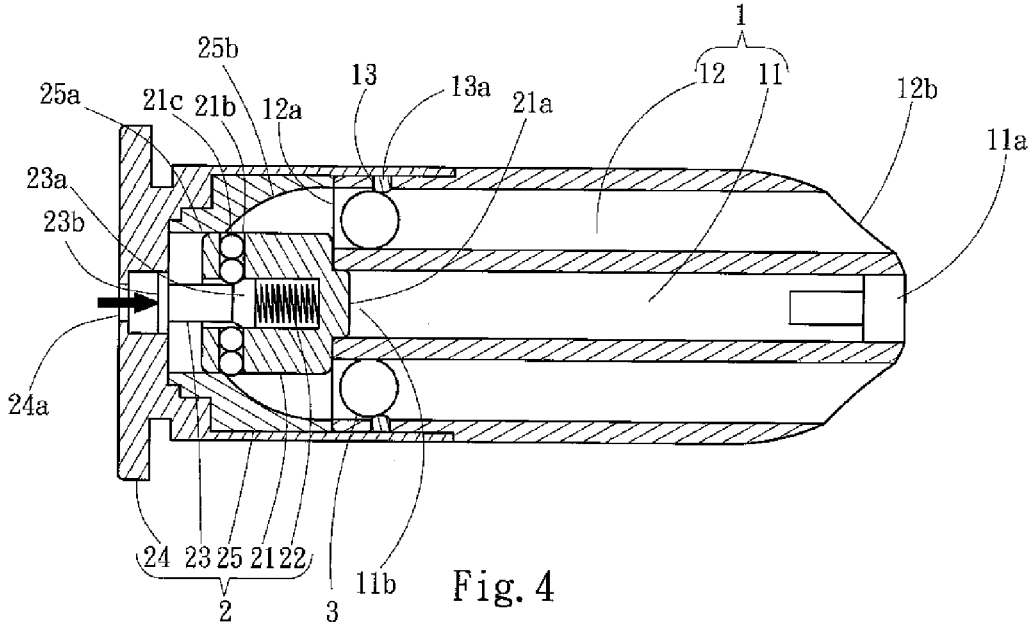
FIG. 4 is a cross sectional view showing the first state of the paintball shooting structure after percussion.
Figure 5:
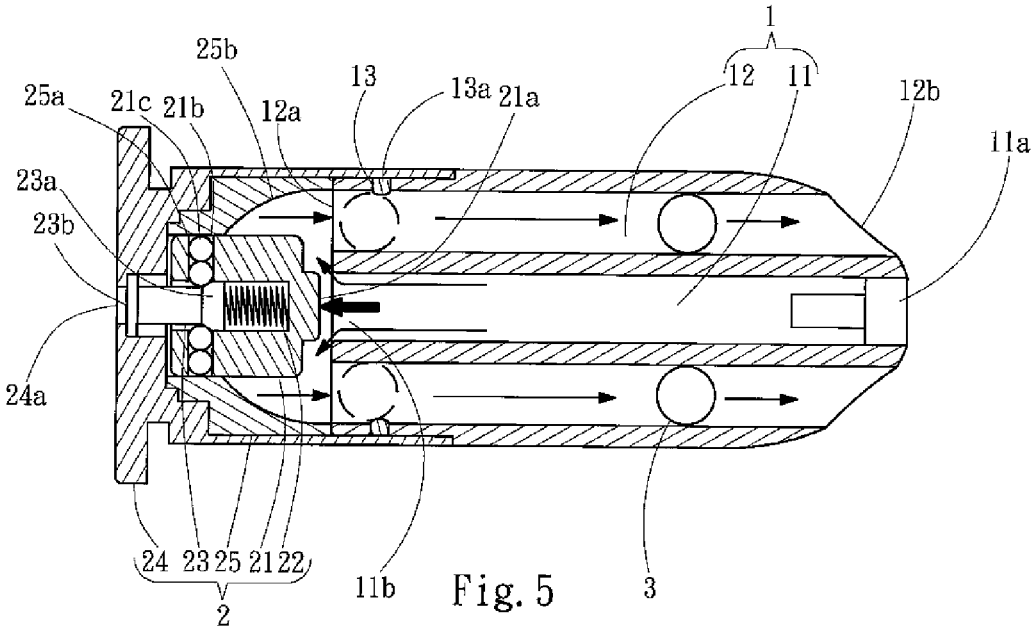
FIG. 5 is a cross sectional view showing the second state of the paintball shooting structure after percussion.

FIG. 4 is a cross sectional view showing the first state of the paintball shooting structure after percussion; FIG. 5 is a cross sectional view showing the second state of the paintball shooting structure after percussion.

When a hammer device (not shown in figures.) strikes the impact section (23*b*) of the firing pin (23), the striking force pushes the firing pin (23) to move forward such that the flange (23*a*) of firing pin (23) pushes the ball (21*c*) to move outward along the receiving hole (21*b*) defined in the plug (21), and compresses the spring (22). After the flange (23*a*) goes through the ball (21*c*), the ball (21) rolls back to clip the firing pin (23) such that the total length from the plug head (21*a*) to the impact section (23*b*) is shortened (see FIG. 4). After that, compressed gas having been injected into the pressure chamber (11) from the gas injected inlet (11*a*) is released from the decompression opening (11*b*) to push the plug to move rearward along the annular section (25*a*) of the trough body (25) until the impact section (23*b*) of the firing pin (23) is abutted against the rear end of the outer sheath (24). Meanwhile, the released compressed gas is reflected and diffused via the bowl-like inner face (25*b*) of the trough body (25) into the paintball inlet (12*a*) so as to shoot each paintball (3) in a respective one of the paintball feeders (12) out of the paintball outlet (12*b*) in the front end of the cartridge (1).

Although this invention has been disclosed and illustrated with reference to particular embodiments, the principles involved are susceptible for use in numerous other embodiments that will be apparent to persons skilled in the art. This invention is, therefore, to be limited only as indicated by the scope of the appended claims.

What is claimed is:

1. A shooting structure comprising a cartridge and a percussion device engaged with the cartridge, the shooting structure provided for receiving at least one paintball for a paintball gun;

the cartridge being a cylindrical body and having therein a pressure chamber and at least one paintball feeder, the pressure chamber and the paintball feeder being defined along an axial direction in the cartridge, the pressure chamber having a gas injection inlet with a non-return mechanism formed on a front end of the cartridge for injecting compressed gas and a decompression opening defined in a rear end of the cartridge, each paintball feeder having a paintball inlet in the rear end of the cartridge and a paintball outlet at the front end of the cartridge; and the percussion device comprising:

a cylindrical plug having a plug head formed on a front end of cylindrical plug, a receiving room defined therein for communicating an open rear end of the plug, and multiple receiving holes extending through the plug and arranged around an annular surface of the plug, the plug head set into the decompression opening to attain a hermetic condition, each receiving hole having at least one ball therein which is partially emerged out of an inner face of the plug;

a spring received in the receiving room of the cylindrical plug;

a firing pin being a tubular object and provided with a flange formed on a front end of the firing pin and an impact section formed on a rear end of the firing pin, a radial dimension of the flange being nominally larger than a dimension of an inscribed periphery formed by emerged portion of the balls received respectively in the receiving holes and around the plug; and an outer sheath having an open front end for engaging with a rear portion of the cartridge and a closed rear end with a through hole defined therein and, a cross-section of the through hole being smaller than a cross-section of the impact section such that the impact section is abutted against the closed end of the outer sheath;

wherein an annular section is defined in an inner rear portion of the outer sheath to receive the plug to slide therein and extendedly frontward forming a trough face with a radial dimension in the most front portion thereof to envelop the decompression opening and the paintball inlet at the rear end of the cartridge;

wherein the flange in the front end of the firing pin shores up the balls in the plug; the impact section of the rear end of the firing pin is abutted against the through hole portion of the outer sheath; the spring received in the plug compresses rearward the flange; and the plug is limited between the rear end of the cartridge and the annular section.

2. The shooting structure of claim 1 wherein the cartridge has multiple paintball feeders provided around the pressure chamber.

3. The shooting structure of claim 1 wherein an annular recess is defined along an annular outer periphery of the cartridge and having such a depth to communicate the paintball feeders; the annular recess is provided with a resilient rubber collar received therein; and the position of the annular recess in an axial direction from the paintball inlet of the cartridge is to match up the dimension of the paintball to restrict the paintball to be located near the paintball inlet.

4. The shooting structure of claim 1 wherein the trough face is a gradually expanded curved surface from the annular section so as to evenly distribute the compressed gas released from the decompression opening to each paintball inlet.

5. The shooting structure of claim 1 wherein the trough face is a staircase-like surface from the annular section so as to evenly distribute the compressed gas released from the decompression opening to each paintball inlet.

6. The shooting structure of claim 1 wherein each ball received in each receiving hole is also partially emerged out of an outer face of the plug.

7. The shooting structure of claim 1 wherein each receiving hole has two balls, one of the balls is partially emerged out of an inner face of the plug and the other ball is partially emerged out of an outer face of the plug.

* * * * *